US010109158B2

(12) United States Patent
Hong

(10) Patent No.: US 10,109,158 B2
(45) Date of Patent: Oct. 23, 2018

(54) DART GAME DEVICE AND DART GAME METHOD PROVIDING BETTING MODE, AND COMPUTER-READABLE MEDIUM

(71) Applicant: HONG INTERNATIONAL CORP., Seoul (KR)

(72) Inventor: Sang Uk Hong, Seoul (KR)

(73) Assignee: Hong International Corp., Seoul (KR)

( * ) Notice: Subject to any disclaimer, the term of this patent is extended or adjusted under 35 U.S.C. 154(b) by 14 days.

(21) Appl. No.: 15/039,220

(22) PCT Filed: Oct. 7, 2014

(86) PCT No.: PCT/KR2014/009435
§ 371 (c)(1),
(2) Date: May 25, 2016

(87) PCT Pub. No.: WO2015/076495
PCT Pub. Date: May 28, 2015

(65) Prior Publication Data
US 2016/0364953 A1 Dec. 15, 2016

(30) Foreign Application Priority Data
Nov. 25, 2013 (KR) ..... 10-2013-0143655

(51) Int. Cl.
*G07F 17/32* (2006.01)
*F41J 3/00* (2006.01)
(Continued)

(52) U.S. Cl.
CPC ..... *G07F 17/3295* (2013.01); *F41J 3/0009* (2013.01); *F41J 3/0028* (2013.01);
(Continued)

(58) Field of Classification Search
CPC ..... A63F 3/00028
See application file for complete search history.

(56) References Cited

U.S. PATENT DOCUMENTS 5,593,349 A * 1/1997 Miguel ..... F41J 3/00 273/371
5,634,639 A 6/1997 Tokito
(Continued)

FOREIGN PATENT DOCUMENTS

EP 2472465 A2 7/2012
JP 07-265491 A 10/1995
(Continued)

OTHER PUBLICATIONS

International Search Report in PCT/KR14/09435, dated Dec. 19, 2014.
(Continued)

*Primary Examiner* — Omkar Deodhar
(74) *Attorney, Agent, or Firm* — McDermott Will & Emery LLP

(57) ABSTRACT

The present disclosure relates to a dart game device and a dart game method for providing a betting mode in a dart game, and a computer-readable medium, and provides a betting mode game method which accumulates credits paid by a player, and calculates and returns the credits. In addition, provided are a device for implementing the method and the computer-readable medium for implementing the method on a computer.

14 Claims, 8 Drawing Sheets

(51) Int. Cl.
*F41J 3/02* (2006.01)
*F41J 5/14* (2006.01)

(52) U.S. Cl.
CPC ..... *F41J 3/0066* (2013.01); *F41J 3/02* (2013.01); *F41J 5/14* (2013.01); *G07F 17/3209* (2013.01); *G07F 17/3211* (2013.01); *G07F 17/3225* (2013.01); *G07F 17/3244* (2013.01); *G07F 17/3276* (2013.01); *G07F 17/3288* (2013.01)

(56) References Cited

U.S. PATENT DOCUMENTS

| | | | | |
|---|---|---|---|---|
| 5,971,397 | A | 10/1999 | Miguel et al. | |
| 2002/0052241 | A1 | 5/2002 | Idaka | |
| 2003/0190944 | A1* | 10/2003 | Manfredi | G07F 17/32 463/20 |
| 2005/0037832 | A1 | 2/2005 | Cannon | |
| 2012/0202587 | A1* | 8/2012 | Allen | G07F 17/3223 463/25 |
| 2012/0242043 | A1 | 9/2012 | Hong | |
| 2012/0258788 | A1 | 10/2012 | Hong | |
| 2013/0079126 | A1* | 3/2013 | Tavano | G07F 17/3288 463/28 |

FOREIGN PATENT DOCUMENTS

| | | | |
|---|---|---|---|
| JP | 2001-357166 | A | 12/2001 |
| JP | 2002095871 | | 4/2002 |
| JP | 2005-500110 | A | 1/2005 |
| JP | 2009-119038 | A | 6/2009 |
| JP | 2012-187378 | A | 10/2012 |
| JP | 2013-502971 | A | 1/2013 |
| KR | 10-2007-0062658 | | 6/2007 |
| KR | 10-2007-0062658 | A | 6/2007 |
| WO | WO 2005/006266 | A2 | 1/2005 |

OTHER PUBLICATIONS

International Preliminary Report on Patentability and Written Opinion in PCT/KR14/09435, dated May 31, 2016.
Office Action, dated Apr. 7, 2017, in Japanese Application No. 2016-534175.
Ridge Racer 7 Complete Guide, Enterbrain Corporation, Feb. 12, 2007, First Edition, p. 016.
Supplementary European Search Report and European Search Opinion from EP Patent Application No. EP14864361.2, search completed Jul. 5, 2017.
Examiners Decision of Refusal in Japanese Application No. 2016-534175, 9 pages, dated Dec. 5, 2017.

* cited by examiner

| CLASS | RATING | 01GAME | S.CRIKET |
|---|---|---|---|
| | | PPD | MPR |
| GRAND MASTER30 | 30 | 48.00 - Above | 6.00 - Above |
| GRAND MASTER29 | 29 | 46.60 - 47.99 | 5.74 - 5.99 |
| GRAND MASTER28 | 28 | 45.20 - 46.59 | 5.48 - 5.73 |
| GRAND MASTER27 | 27 | 43.80 - 45.19 | 5.22 - 5.47 |
| MASTER26 | 26 | 42.40 - 43.79 | 4.96 - 5.21 |
| MASTER25 | 25 | 41.00 - 42.39 | 4.70 - 4.95 |
| AAA24 | 24 | 39.60 - 40.99 | 4.49 - 4.69 |
| AAA23 | 23 | 38.20 - 39.59 | 4.28 - 4.48 |
| AAA22 | 22 | 36.80 - 38.19 | 4.07 - 4.27 |
| AAA21 | 21 | 35.40 - 36.79 | 3.86 - 4.06 |
| AA20 | 20 | 34.05 - 35.39 | 3.71 - 3.85 |
| AA19 | 19 | 32.70 - 34.04 | 3.56 - 3.70 |
| AA18 | 18 | 31.35 - 32.69 | 3.41 - 3.55 |
| AA17 | 17 | 30.00 - 31.34 | 3.26 - 3.40 |
| A16 | 16 | 28.65 - 29.99 | 3.11 - 3.25 |
| A15 | 15 | 27.30 - 28.64 | 2.96 - 3.10 |
| A14 | 14 | 25.95 - 27.29 | 2.81 - 2.95 |
| BBB13 | 13 | 24.65 - 25.94 | 2.66 - 2.80 |
| BBB12 | 12 | 23.35 - 24.64 | 2.51 - 2.65 |
| BB11 | 11 | 22.05 - 23.34 | 2.36 - 2.50 |
| BB10 | 10 | 20.75 - 22.04 | 2.21 - 2.35 |
| B9 | 9 | 19.45 - 20.74 | 2.06 - 2.20 |
| B8 | 8 | 18.15 - 19.44 | 1.91 - 2.05 |
| CCC7 | 7 | 16.90 - 18.14 | 1.76 - 1.90 |
| CCC6 | 6 | 15.65 - 16.89 | 1.61 - 1.75 |
| CC5 | 5 | 14.40 - 15.64 | 1.46 - 1.60 |
| CC4 | 4 | 13.15 - 14.39 | 1.31 - 1.45 |
| C3 | 3 | 11.90 - 13.14 | 1.20 - 1.30 |
| C2 | 2 | 10.65 - 11.89 | 1.10 - 1.19 |
| N1 | 1 | 0.00 - 10.64 | 0.00 - 1.09 |

FIG. 4

DART GAME DEVICE AND DART GAME METHOD PROVIDING BETTING MODE, AND COMPUTER-READABLE MEDIUM

CLAIM OF PRIORITY

This application is the U.S. national stage under 35 U.S.C. § 371 of International Application Number PCT/KR2014/009435, having an international filing date of Oct. 7, 2014, which claims benefit of priority to South Korea Patent Application Number 10-2013-0143655, filed Nov. 25, 2013, which applications are incorporated herein by reference.

TECHNICAL FIELD

The present disclosure relates to a dart game device, and particularly, to a dart game device for providing a betting mode to a player of the dart game device.

BACKGROUND ART

In general, a dart refers to a 'small arrow' and is a game that makes marks by throwing an arrow-shaped dart pin to a centrifugal target marked with figures. The dart game has an advantage in that anybody can enjoy the dart game anytime and anywhere if there are only an arrowheaded dart and the dart target. In recent years, as the dart game has been developed as worldwide leisure due to development of various game methods and arrangement of a scoring method in association with the dart game, any adults and children have conveniently enjoyed the dart game.

In general, participants of the dart game need to participate in the game at the same time and in the same space in order to enjoy the dart game. However, with development of communication technology, each of the participants of the dart game may remotely participate in the dart game and remotely transmit a play process or a play result thereof through a communication network. As a result, the participants of the dart game may participate in the game over a temporal and spatial restriction.

Electronic dart game devices have been developed so as to remotely participate in the dart game and transmit a play result or a play process thereof through a communication network. The electronic dart game devices can electrically sense a hitting point of the dart target and automatically aggregate scores and provide the aggregated scores to a user.

Although players of the dart game devices frequently use the dart game as a means for betting, the betting is performed only by consent of the players, and as a result, the players may conflict with each other and/or a speculation problem may occur due to the betting. Accordingly, in order to solve the problem, a betting mode needs to be provided, in which the dart game device can perform the betting among the players in order to provide additional pleasure to the players in addition to a limited game method, prevent the confliction of the players associated with the betting, and allow the players to enjoy the dart game healthy and pleasantly.

DISCLOSURE

Technical Problem

The present disclosure has been made in an effort to provide a dart game device and a dart game method for allowing a dart game device to perform betting performed by only consent of players who play a dart game in the related art, and a computer-readable medium.

Technical Solution

Disclosed is a dart game device providing a betting dart game mode according to an embodiment of the present disclosure in order to implement the aforementioned object. The dart game device may include: a user input unit receiving an input for selecting a dart game scheme and a betting mode from one or more players; a controller accumulating credits paid from the one or more players, allowing the one or more players to play a dart game based on the selected dart game scheme, and calculating the accumulated credits of the one or more players based on a result depending on the selected game scheme; and an output unit outputting the result depending on the selected game scheme. That is, the dart game device provides a betting mode in a dart game by a method in which additional cost for permitting additional betting to game cost is paid from a player and the additional cost is accumulated as a credit and thereafter, the credit is calculated and returned according to a result of a game.

In an embodiment of the present disclosure, disclosed is a method for providing a betting dart game mode. The method may include: receiving an input for selecting a dart game scheme and a betting mode from one or more players; accumulating credits paid from the one or more players; allowing the one or more players to perform a dart game based on the selected dart game scheme; outputting the result depending on the selected game scheme and calculating the accumulated credits of the one or more players based on a result depending on the selected game scheme.

According to an embodiment of the present disclosure, disclosed is a computer readable medium having a program which allows a computer to provide a betting mode to a player of a dart game device recorded therein when the program is executed by the computer. Herein, the program stored in the computer-readable medium may include: a code for allowing the computer to receive an input for selecting a dart game scheme and a betting mode from one or more players; a code for allowing the computer to accumulate paid credits from the one or more players; a code for allowing the computer to allow the one or more players to perform a dart game based on the selected game scheme; a code for allowing the computer to output the result depending on the selected game scheme and a code for allowing the computer to calculate the accumulated credits of the one or more players based on a result depending on the selected game scheme.

Advantageous Effects

As compared with the related art in which betting is achieved only by consent of players, a dart game device takes the lead in betting and calculates credits by determining a result, and returns the credits to prevent confliction among the players and efficiently and pleasantly enjoy a betting dart game.

DESCRIPTION OF DRAWINGS

FIG. 4 is a diagram illustrating one example of rating and/or class which can be granted to a player according to PPD and/or MPR.

BEST MODE

Figure 1:
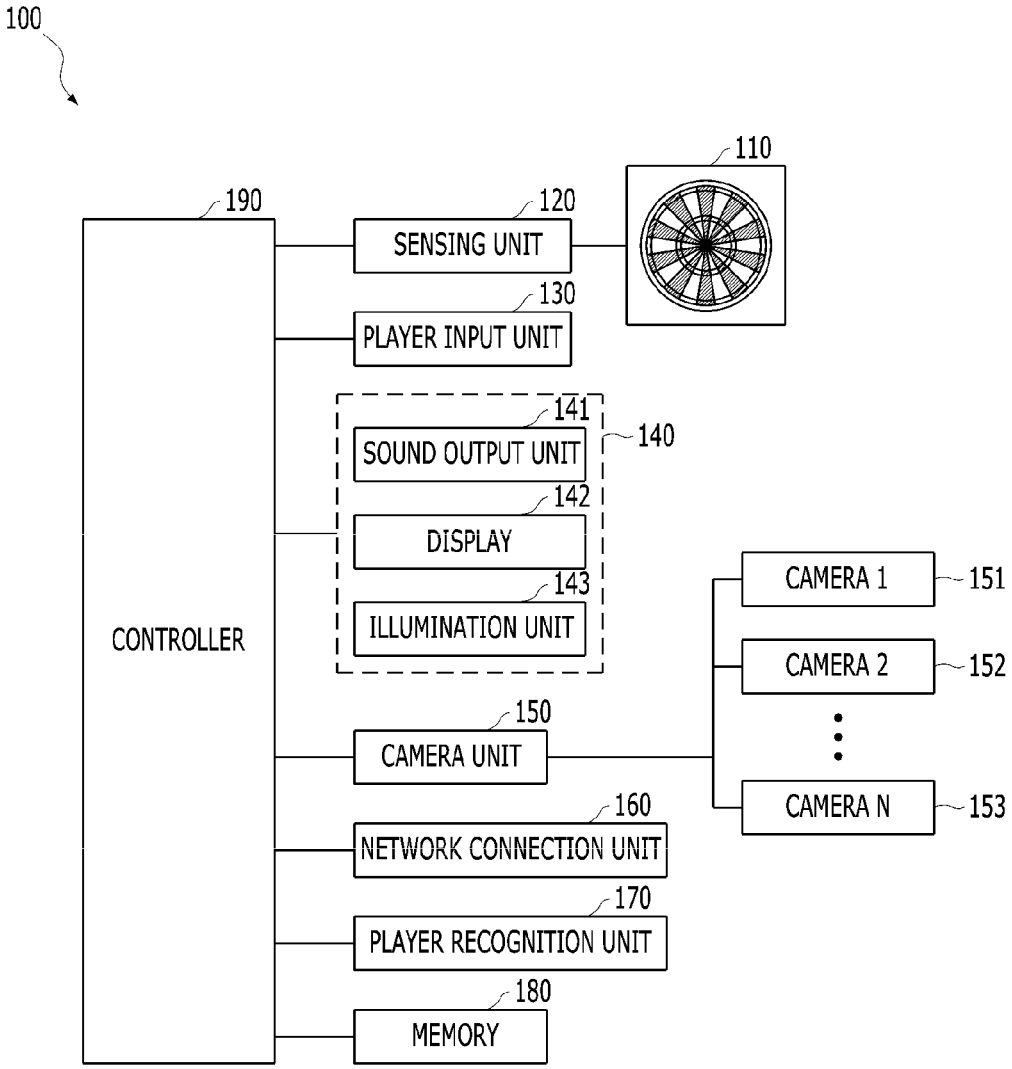
FIG. 1 is a block diagram of a dart game device according to an embodiment of the present disclosure.

Various embodiments will now be described with reference to the drawings and similar reference numerals are used to represent similar elements throughout the drawings. In the specification, various descriptions are presented to provide appreciation of the present disclosure. However, it is apparent that the embodiments can be executed without the specific description. In other examples, known structures and apparatuses are provided in a block diagram form in order to facilitate description of the embodiments.

"Component", "module", "system", and the like which are terms used in the specification designate a computer-related entity, hardware, firmware, software, and a combination of the software and the hardware, or execution of the software. For example, the component may be a processing process executed on a processor, the processor, an object, an execution thread, a program, and/or a computer, but is not limited thereto. For example, both an application executed in a computing device and the computing device may be the components. One or more components may reside in the processor and/or execution thread and one component may be localized in one computer or distributed among two or more computers. Further, the components may be executed by various computer-readable media having various data structures, which are stored therein. The components may perform communication through local and/or remote processing according to a signal (for example, data through other system and a network such as the Internet through data and/or a signal from one component that interacts with other components in a local system and a distribution system) having one or more data packets, for example.

The description of the presented embodiments is provided so that those skilled in the art of the present disclosure use or carry out the present disclosure. Various modifications of the embodiments will be apparent to those skilled in the art and general principles defined herein can be applied to other embodiments without departing from the scope of the present disclosure. Therefore, the present disclosure is not limited to the embodiments presented herein, but should be analyzed within the widest range which is consistent with the principles and new features presented herein.

FIG. 1 is a block diagram of a dart game device according to an embodiment of the present disclosure.

The dart game device 100 may include a dart target 110, a sensing unit 120, a user input unit 130, an output unit 140, a camera unit 150, a network connection unit 160, a user recognition unit 170, a memory 180, a controller 190, and the like. The components illustrated in FIG. 1 are not essential components. Therefore, a mobile terminal having more components there than or less components there than may be implemented.

Hereinafter, the components will be described in sequence.

The dart target 110 may include a score board in which a bullseye is positioned at the center and there are areas segmented by a concentric circle centering the bullseye and straight lines extended radially from the bullseye and granted with individual scores, respectively. A plurality of holes into which a tip of a dart may be inserted may be deployed on the score board.

The dart target 110 includes a display 142 to be described below to variably change score deployment of the dart target 110 and shapes of areas granted with the scores. In this case, the dart target 110 includes a light transmissive touch pad in the display 142 to be stacked to have a form of a touch screen.

The sensing unit 120 senses a play of a dart game player performed with respect to the dart target 110. The sensing unit 120 may actually evaluate the play of the game player. The sensing unit 120 may sense an area of the dart target 110 which the thrown dart hits, with respect to a play in which the game player throws the dart. The sensing unit 120 electrically converts a score corresponding to the area which the dart hits to transmit the converted score to the controller 190.

The user input unit 130 receives an input of a user for controlling the dart game device 100. The user input unit 130 may include a keypad, a dome switch, a touch pad (resistive/capacitive), a jog wheel, a jog switch, and the like. The user input unit 130 may further include cameras 151 to 153, a microphone, or the like.

The user input unit 130 may further include a short range communication module (not illustrated). The user input unit 130 may be configured to include the short range communication module (not illustrated) of the network connection unit 160. When the user input unit 130 includes the short range communication module of the network connection unit 160, the user input unit 130 may be configured to receive a user's input which is input by an external console device. As a short range communication technology, Bluetooth, radio frequency identification (RFID), infrared data association (IrDA), ultra wideband (UWB), ZigBee, or the like may be used.

For example, when the user input unit 130 performs the short range communication using infrared communication, the external console device may be an infrared remote controller. Alternatively, when the user input unit 130 performs the short range communication using a Bluetooth function, the external console device may be a mobile device including a Bluetooth module. The mobile device including the Bluetooth module may be, for example, a smart phone including the Bluetooth module.

The user may select a dart game mode, a betting mode or not the number of dart game players, a dart game play mode, a value of a credit, a calculation rate of the credit, a handicap mode, and the like through the user input unit 130. For example, the user may select the number of dart game players, the dart game play scheme (a zero one game, a cricket game, and the like), and the dart game mode (a single play, a network play, the betting mode, the handicap mode, and the like), the value of the credit, cost for permitting additional betting, and the calculation rate of the credit in the calculation after the game ends through the user input unit 130.

The user input unit 130 receives a signal by sensing a key operation or a touch input of the user or receives voice or a motion through the cameras 151 to 153 or the microphone of the user to convert the received signal, voice, or motion into an input signal. To this end, known speech recognition or motion recognition technologies may be used.

The output unit 140 which is used for generating an output related with sight, hearing, or touch may include a sound output unit 141, a display 142, an illumination unit 143, and the like.

The sound output module 141 may output audio data received from the network connection unit 160 or stored in the memory 180 in a sound effect of the game, a game motion guide, a game method description, and the like. The sound output module 141 may also output a sound signal related with a function (e.g., a game effect sound) performed by the dart game device 100. The sound output module 141 may also output a voice from a game player or a third person using another dart game device 200 (see FIG. 2) received through the network connection unit 160. The sound output module 141 may include a receiver, a speaker, a buzzer, and the like.

The display 142 displays (outputs) information processed in the dart game device 100. For example, when the dart game device 100 is in a game play mode guidance mode, the display 142 may output a selectable game play mode. When the dart game device 100 plays a game, the display 142 may display the score sensed through the sensing unit 120 or output an image acquired by photographing the game player or the third person using another dart game device 200 (see FIG. 2) received through the network connection unit 160. In an aspect of the present disclosure, the display 142 may display a result for the betting mode and a calculation result for the betting mode.

The display 142 may include at least one of a liquid crystal display (LCD), a thin film transistor-liquid crystal display (TFT LCD), an organic light-emitting diode (OLED), a flexible display, and a 3D display.

Some of the displays may be configured as a transparent or light transmissive type to view the outside through the displays. This may be called a transparent display and a representative example of the transparent display includes a transparent OLED (TOLED), and the like.

In an aspect of the present disclosure, two or more displays 142 may be present according to an implementation form of the dart game device 100. For example, in the dart game device 100, a plurality of displays may be deployed on one surface to be separated or integrally and further, deployed on different surfaces, respectively. For example, the display 142 may include both a display 142 disposed at an upper end of the target 110 and a display disposed at a lower end of the target 110, or may include one display 142 thereof. However, a location where the aforementioned displays are disposed is an example, and the display may be disposed at various positions for a demand due to a design or a visual effect.

A touch sensor may be configured to convert pressure applied to a specific portion of the display 142 or a change in capacitance generated at the specific portion of the display 142 into an electrical input signal. The touch sensor may be configured to detect touch pressure as well as touched location and area.

When there is a touch input for the touch sensor, a signal(s) corresponding to the touch input is sent to a touch controller. The touch controller processes the signal(s) and thereafter, transmits data corresponding thereto to the controller 190. As a result, the controller 190 may know which area of the display 142 is touched.

The illumination unit 143 outputs a signal for notifying occurrence of an event of the dart game device 100. Examples of the event which occur in the dart game device 100 include identification of the dart game player, direct hit of the dart, a change of the dart game player, game over, and the like. The illumination unit 143 may include a light emission diode (LED) and notify the occurrence of the event to the user through flickering of the LED.

The LEDs are disposed on the bottom of the dart target 110 to be flickered according to a flickering pattern which is pre-stored according to the occurrence of the event. For example, one or more LEDs may be allocated to respective parts of the dart target 110. The allocated LEDs are disposed on the bottom of the dart target 110 and may be disposed in a direction orienting the outside of the dart game device 100. When the LEDs irradiate light, the light irradiated by the LEDs may pass through the dart target 110 made of a transparent or translucent material to transfer a visual output to the user. Alternatively, the light irradiated by the LEDs may transfer the visual output to the user through a gap existing in the dart target 110.

The output unit 140 may also output another form other than a video signal or an audio signal, for example, a signal for notifying the occurrence of the event by vibration.

The camera unit 150 includes multiple cameras 151 to 153, and as a result, an image frame processed by the cameras 151 to 153 may be stored in the memory 180 or transmitted to the outside through the network connection unit 160. Two or more cameras 150 may be provided according to a use environment.

At least some cameras of the camera unit 150 may be disposed to photograph an image frame including the dart target 110 and other cameras may be disposed to photograph an image frame directly related with a game rule in the dart game play. For example, the camera may be disposed to photograph a throw-line on which the dart is thrown in order to photograph the image frame directly related with the dart game rule. The multiple cameras 151 to 153 included in the camera unit 150 may be disposed to photograph at least some image frames to overlap with each other.

When the camera unit 150 includes one camera, the camera may be a panorama camera disposed to photograph both at least a part of the dart target 110 and the image frame (e.g., the throw-line in the dart game) directly related with the game rule.

The network connection unit 160 may include one or more modules that enable wireless communication between the dart game device 100 and a wired/wireless communication system or between the dart game device 100 and a network on which the dart game device 100 is positioned.

The network connection unit 160 may include a wired/wireless Internet module for accessing the network. As the wireless Internet technology, wireless LAN (WLAN) (Wi-Fi), wireless broadband (Wibro), world interoperability for microwave access (Wimax), high speed downlink packet access (HSDPA), or the like, may be used. As a wired Internet technology, digital subscriber line (XDSL), fibers to the home (FTTH), power line communication (PLC), or the like may be used.

Further, the network connection unit 160 includes a short-range communication module to transmit and receive data to and from an electronic apparatus positioned in a comparatively short range from the dart game device 100 and including the short-distance communication module. As a short range communication technology, Bluetooth, radio frequency identification (RFID), infrared data association (IrDA), ultra wideband (UWB), ZigBee, or the like may be used.

The network connection unit 160 may sense a connection state of the network and a transceiving speed of the network.

Data received through the network connection unit 160 may be output through the output unit 140, stored through the memory 180, or transmitted to other electronic apparatuses positioned in a short range through the short-range communication module.

The user recognition unit 170 recognizes unique information of a long-range user by using a radio wave through the radio frequency identification (RFID) technology which is a kind of the short range communication technology. For example, the user may possess a card, a mobile terminal, or unique dart game equipment, for example, his/her own personal dart equipment, which includes an RFID module. Information (e.g., a personal ID, an identification code, and the like of the user registered in the database server (DB) (see FIG. 2) for identifying the user may be recorded in the RFID module possessed by the user. The dart game device 100 may identify the RFID module possessed by the user to identify a dart game player which plays the game by using the dart game device 100 and update a database for the identified dart game player or accumulate new data.

The user recognition unit 170 may include various technologies (e.g., the short-range communication technology such as Bluetooth and the like) that may transmit and receive unique information of the user by a contact/non-contact method in addition to the RFID technology. Further, the user recognition unit 170 may include a biodata identification module that identifies biodata (voice, a fingerprint, and a face) of the user by interworking with the microphone of the user input unit 130, the touch pad, the camera unit 150, and the like.

The memory 180 may store a program for an operation of the controller 190 therein and temporarily store input/output data (e.g., a phone book, a message, a still image, a moving picture, the game mode, the value of the credit, the return rate of the credit, and the like) therein. The memory 180 may store data regarding various patterns of vibrations and sounds output in the touch input on the touch screen.

The memory 180 may include at least one type of storage medium of a flash memory type storage medium, a hard disk type storage medium, a multimedia card micro type storage medium, a card type memory (for example, an SD or XD memory, or the like), a random access memory (RAM), a static random access memory (SRAM), a read-only memory (ROM), an electrically erasable programmable read-only memory (EEPROM), a programmable read-only memory (PROM), a magnetic memory, a magnetic disk, and an optical disk. The dart game device 100 may operate in connection with a web storage performing a storing function of the memory 180 on the Internet.

The controller 190 generally controls all operations of the dart game device 100. For example, in the case of the dart game, the controller 190 may aggregate the scores sensed through the sensing unit 120 for each game participant, transmit/receive the aggregated scores to/from another dart game device 200 connected through the network, allow the player to perform the dart game, accumulate the credits paid by the player, calculate the credits according to a rate set as default or a rate set by the player, return the calculated credits according to the rate set as default or the rate set by the player, transmit a participation application of the dart game to another dart game device 200 or another terminal (mobile device) 300, record winning/losing of the game according to the aggregation result, and return the accumulated credits according to the aggregation result and the game mode. Another terminal (mobile device) 300 may be an electronic board, a smart phone, a tablet PC, a computer, a notebook, and the like and allow one or more players who do not join the game to recognize a joining request of the player.

The controller may perform pattern recognition processing to recognize a motion input, a writing input, and the like performed in the touch screen or the camera as a letter or an image. Further, the controller may perform speech recognition by using a speech-to-text (STT) function to recognize the speech input through the microphone as the letter.

Various embodiments described herein may be implemented in a computer-readable recording medium or a recording medium readable by a device similar to the computer by using, for example, software, hardware, or a combination thereof.

According to hardware implementation, the embodiment described herein may be implemented by using at least one of application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, and electric units for performing other functions. In some cases, the embodiments described in the specification may be implemented by the controller 190 itself.

According to software implementation, embodiments such as a procedure and a function described in the specification may be implemented by separate software modules. Each of the software modules may perform one or more functions and operations described in the specification. A software code may be implemented by a software application written by an appropriate program language. The software code may be stored in the memory 180 and executed by the controller 190.

Hereinafter, a state in which the dart game device according to the embodiment of the present disclosure is connected with the network will be described in more detail with reference to the drawings.

Figure 2:
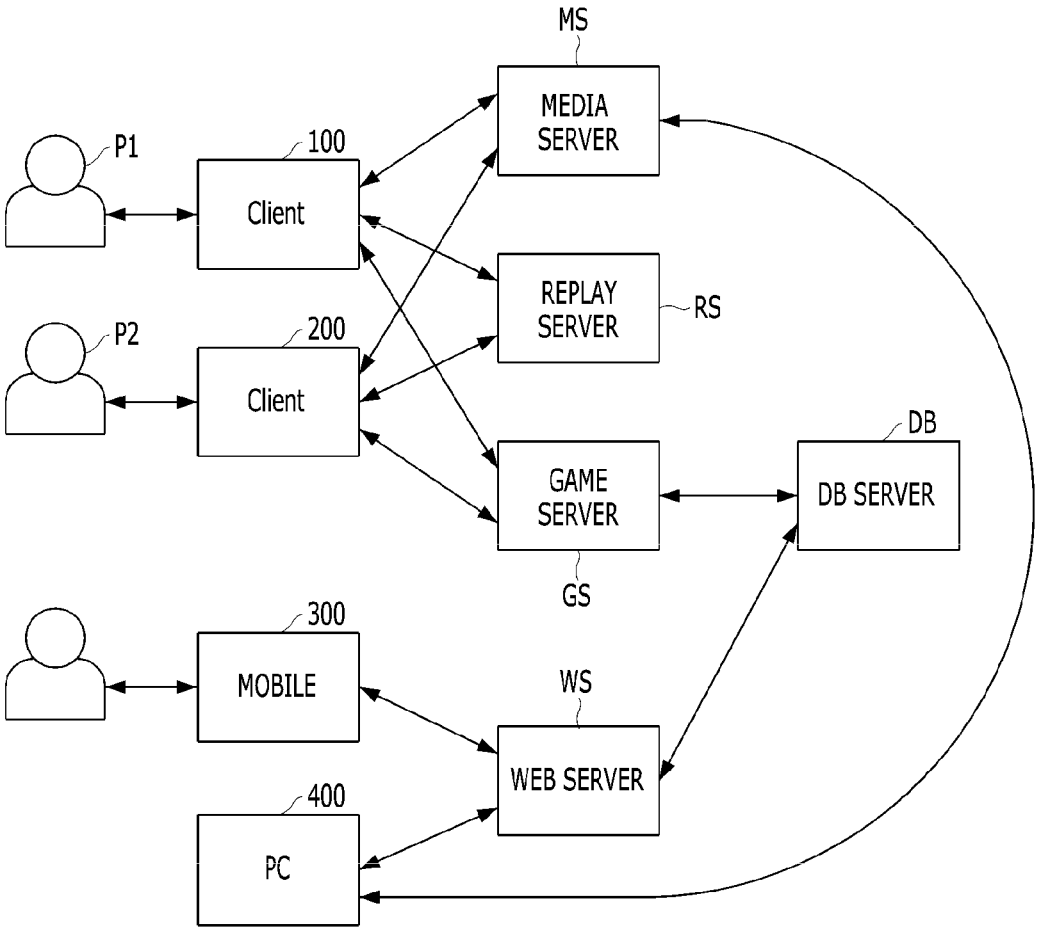
FIG. 2 is a conceptual diagram of a game network including a dart game device according to an embodiment of the present disclosure.

FIG. 2 is a conceptual diagram of a game network including a dart game device according to an embodiment of the present disclosure.

As illustrated in FIG. 2, the dart game device 100 used by a first game player P1 may be connected with one or more servers (a media server MS, a relay server RS, and a dart game server GS) through the network.

A plurality of dart game players may enjoy the dart game in the same space at the same time by using the same first dart game device 100. However, when a second dart game player P2 positioned at a remote range from the first dart game player P1 intends to participate in the dart game, the second dart game player P2 is connected with one or more servers (the media server MS, the relay server RS, and the dart game server GS) through the network by using the second dart game device 200 to transmit and receive information to and from the first dart game device 100, thereby performing the dart game. The first dart game device 100 and the second dart game device may transmit and receive information via one or more servers (the media server MS, the relay server RS, and the dart game server GS) or directly transmit and receive the information between the dart game devices 100 and 200.

The dart game may be performed at different places at which both dart game players P1 and P2 play at the same time or performed by a method in which both dart game players P1 and P2 play the dart game at different places and at different time and decide winning/losing or a ranking by storing play contents in the DB server DB.

The media server MS may store dart game play moving pictures of the dart game players P1 and P2, which are stored by using the camera or the microphone stored in the dart game devices 100 and 200. The media server MS may be included in the DB server DB.

The relay server RS connects communication between the plurality of dart game devices 100 and 200. The relay server RS forms a communication network between the plurality of dart game devices 100 and 200 positioned at the remote range to form a peer-to-peer (P2P) network.

The game server GS may exchange information (a score acquired by each game player and information for mutual communication among the respective game players) between the dart game devices 100 and 200, transmit an advantage or a warning based on a game rule through the respective dart game devices 100 and 200, or besides, perform transmission and reception of information required to perform the dart game and control of the dart game devices 100 and 200. The dart game server GS aggregates winning/losing of the dart game and scores of the respective dart game players P1 and P2 to transmit the aggregated winning/losing and scores to the DB server.

The DB server may store personal information of the respective dart game players P1 and P2, winning/losing and ranking information of the game, score information for each game, or a replay moving picture for each game. The DB server may store the information segmented for each user. The DB server may grant a unique code to each user and manage information for each user by using the unique code. The unique code may be stored in the RFID module (an RFID card or an RFID module stored in the mobile terminal) possessed by each user. As a result, the game devices 100 and 200 may identify each game player through the included user recognition unit 170. The DB server may also grant the unique code for identification even to the respective dart game devices 100 and 200 and manage the dart game data for each identification code granted to the dart game devices 100 and 200.

The game player may access a web server WS by using a mobile 300 (including electronic apparatuses such as a mobile terminal, a cellular phone, a PDA, a PDP, and the like, which have a mobile communication function) or a PC 400. The web server WS may be connected with the mobiles 300 and 400 by an Internet or an Intranet. Further, the web server WS may be connected even with the dart game devices 100 and 200. The web server WS is connected with the DB server DB to provide the dart game data stored in the DB server to the dart game player.

Figure 3:
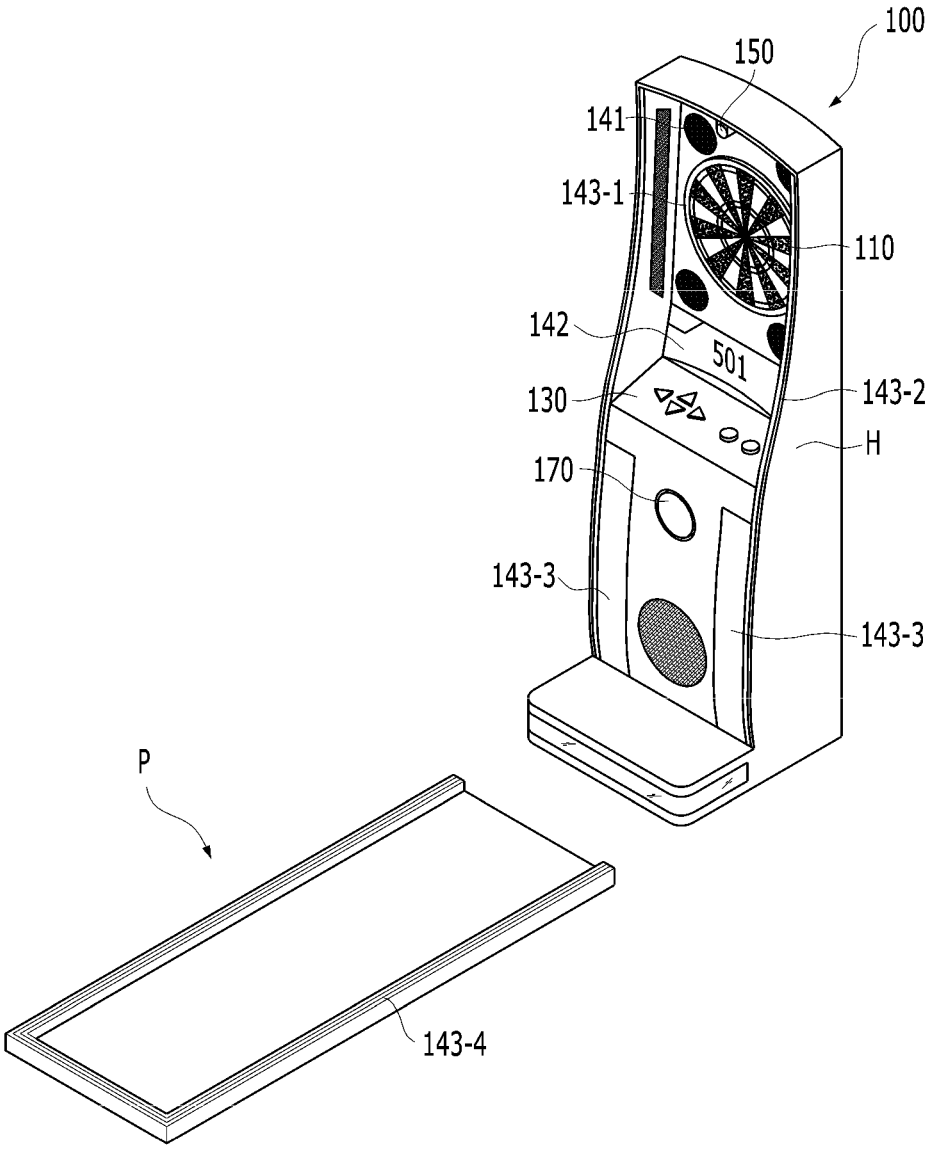
FIG. 3 is a perspective view of a dart game device according to an embodiment of the present disclosure.

FIG. 3 is a perspective view of a dart game device according to an embodiment of the present disclosure.

As illustrated in FIG. 2, the dart game device 100 according to the embodiment of the present disclosure may be formed by mounting the components illustrated in FIG. 1 in a housing H. A dart target 110, a display 142, an illumination unit 143, a sound output unit 141, a camera unit 150, and a user recognition unit 170 may be disposed on the front surface of the dart game device 100.

The dart target 110 may be disposed so that a dead centre is positioned at a position (for example, 5 feet 8 inches in a vertical direction from the ground) suitable for a rule of the dart game. The illumination units 143-1, 143-2, and 143-3 may be disposed at various parts of the dart game device 100 to transfer a visual effect to the player of the dart game device 100.

For example, the illumination unit 143-1 is disposed on the side of the dart target 110 and may serve to irradiate an illumination to the dart target 110. The illumination unit 143-1 may also output a predetermined illumination effect according to an event of the dart game. Further, the illumination unit 143-1 may output illumination effects having various colors.

The illumination unit 143-2 may be formed to be extended in a vertical direction along a forward projection of the housing H. Like the illumination unit 143-1, the illumination unit 143-2 may output a predetermined illumination effect according to an event of the dart game and output illumination effects having various colors.

The illumination unit 143-3 may be disposed on the side of the user recognition unit 170.

The illumination unit 143-3 may output a predetermined illumination effect according to an event of the dart game and output illumination effects having various colors. Particularly, the illumination unit 143-3 may output an illumination effect for an event related with the user recognition unit 170.

Selectively, the dart game device 100 may include a dart plate P which may be selectively connected with the dart game device 100 and extended in a horizontal direction. The dart plate P may further include an illumination unit 143-4. The dart plate P may be integrally coupled with or selectively attached to or detached from the dart game device 100.

When the dart plate P is integrally coupled with or selectively attached to the dart game device 100, the dart plate P may be electrically connected with the dart game device 100. The illumination unit 143-4 of the dart game device 100 may be disposed along the outer periphery of the dart plate P as illustrated in FIG. 3. One end of the dart plate P may be extended to a place where a throw-line is to be positioned along a distance of the throw-line from the dart target according to a rule of the game. The illumination unit 143-4 may be disposed at a position corresponding to the throw-line.

Although not illustrated in FIG. 3, an illumination unit (not illustrated) is disposed at the bottom of the dart target 110 to irradiate an illumination effect in a user direction. The illumination unit (not illustrated) may include a combination of different illumination elements allocated according to each segment configuring the dart target.

The housing H of the dart game device 100 may include the display 142 disposed in the user direction. The display 142 may display information required to the user according to the progress of the dart game (for example, a collected score, information on a player during playing, a score required for clearing the corresponding game, information of an opposite player which does not play the game, information associated with the betting, and the like). The display 142 may display a visual effect according to an event depending on the progress of the dart game. For example, when the user continuously hits a bullseye at the dead center of the dart target 100 at three dart throw chances, the display 142 may display a pre-stored motion picture corresponding to the corresponding event. The motion picture may be stored in the memory 180 of the dart game device 100 or received from a server through the network connection unit 160.

The display 142 may provide the user with visual and audible effects according to occurrence of the event by interlocking with the illumination units 143-1, 143-2, 143-3, and 143-4 and the sound output unit 140. In other words, when a predetermined event occurs, the display 142, the illumination units 143-1, 143-2, 143-3, and 143-4, and the sound output unit 140 may output an illumination effect, a display effect, and a sound effect with respect to the corresponding event.

In FIG. 3, it is illustrated that the display 142 is disposed at the lower end of the dart target 110, but the number and disposed positions of displays 142 may be variously modified.

The user input unit 130 may be configured in a key pad button form as illustrated in FIG. 3. However, as described above, the user input unit 130 may be configured by various types including a touch screen or a display device mapped with a dart plate. The user operates a key button of the user input unit 130 to select a mode of a game to be played by the user, and the like. In an embodiment of the present disclosure, in the display device mapped with the dart plate, when the user applies pressure to a part of the dart plate (for example, when the user presses a part of the dart plate), specific figures, letters, or other contents mapped with a part of the dart plate to which the pressure is applied may be input based on a predetermined algorithm. As an example, a predetermined screen corresponding to the dart plate may be output through the display, and the like and when the pressure is applied to a part of the dart plate, a part mapped with the dart plate in the predetermined screen may be input according to a specific algorithm.

The sound output unit 141 is also disposed on the front surface of the housing H of the dart game device 100 to output a sound. The number and disposed positions of sound output units 141 may also be variously modified.

The camera unit 150 may be mounted on the top of the housing H of the dart game device 100 as illustrated in FIG. 3. The camera unit 150 may include one or more cameras 151 to 153 which may photograph the dart target 110 and the throw line. The image photographed through the camera unit 150 may be transferred to the memory 180. According to an embodiment, only some of the motion pictures photographed by the camera unit 150 may be finally stored in the memory 180 or transferred to a server (not illustrated) through the network communication unit 160.

The user recognition unit 170 may be disposed on the front surface of the housing H of the dart game device 100 and include a short range communication module as illustrated in FIG. 3. The user touches a card for recognizing the user near the user recognition unit 170 to complete user authentication.

The contents illustrated in FIG. 3 and the description of the exterior of the aforementioned dart game device 100 are just an example proposed for description, and the dart game device 100 according to the present disclosure is not limited to the exterior illustrated in FIG. 3.

Hereinafter, a representative rule of the dart game and stats of the player associated therewith will be described.

The dart game which may be executed by the dart game device 100 according to the embodiment of the present disclosure may include a 01 game (zero-one game), a cricket game, a count-up game, a match-up mode, and the like.

The 01 game is performed by two teams (alternatively, two players) throwing the dart to the dart target alternately one by one round. One round includes three dart throwing operations. An object of the game is that aggregation of scores in each round reaches a target score (a score of the unit of 100 or 1000 that generally ends with 01, such as 301, 501, 701, 901, 1101, 1501 points, and the like). The target score and a play round may be arbitrarily adjusted according to the number of players that participate in the round.

In the cricket game, the round is performed by throwing three darts in a first round similarly to the 01 game. The standard cricket game may be performed by using only a bull region at the center of the dart target, and 20, 19, 18, 17, 16, and 15 point regions. When the corresponding cricket figures are hit with 3 marks, this is marked as a position of the player and when the corresponding cricket figures are hit with 4 marks or more, scores corresponding to the figures are added up to compete the scores. Herein, double regions and triple regions of the dart target may be calculated as 2 marks and 3 marks, respectively. While the corresponding cricket figure is marked as the position of the player, when a counterpart of the player also marks a cricket figure of 3, the corresponding cricket figure is regarded to be closed and no score may be added up any longer. The object of the game may be set to acquire a high score until a regulation round ends or close all cricket figures and acquire a higher score than the counterpart.

The count-up game is a game at which the player wins when acquiring a high score within a predetermined round.

In addition to the aforementioned games, various types of games may be played by the dart game device 100 and the play mode of the dart game device 100 is not limited to the aforementioned game schemes.

The stats of the player may be defined according to the corresponding game rule independently from the winning or losing of the count-up game, the cricket game, and the 01 game.

For example, points per dart (PPD) may be calculated by dividing a total score which the player earns by the number of dart throwing times in the 01 game.

Alternatively, marks per round (MPR) may be calculated by calculating the number of marking times of the player in one round. For example, in the cricket game, when the player performs three dart throwing operations in one round and the darts hit 15 triple, 19 single, and 20 double in the three dart throwing operations, respectively, the MPR becomes (3+1+2)/1=6.00 (MPR).

In a subsequent round, when the player performs three dart throwing operations and the darts hit mark fail, 18 double, and 20 single in the three dart throwing operations, the MPR becomes (3+1+2+0+2+1)/2=4.5 (MPR).

The PPD and the MPR or the stats of the player may also be stored as personal data of the player. Alternatively, in the count-up game, an average score of the player per game, a highest score record of the player per game, and the like may be stored as the stats of the player.

The dart game device 100 may play the dart game according to the corresponding mode and transmit a game record per player to a game server GS or a DB server DB. The game server GS or DB server DB may calculate the PPD and/or MPR for each player according to the corresponding game record and store the calculated PPD and/or MPR as accumulated PPD and/or MPR stats of the player. Further, the game server GS or the DB server DB may individually store the game record of the player. For example, in the 01 game, the count-up game, or the cricket game which the player played in the past, the game server GS or the DB server DB may record information on a segment part of a dart which the player hits each dart throwing. The game server GS or DB server DB may store accumulated (average) PPD and/or MPR data and highest PPD and/or MPR data of the player.

The game server GS or the DB server DB may be two physically separated servers. Alternatively, the game server GS or the DB server DB may be one physically integrated server and be distinguished according to roles performed in the server. Further, as described above, one server may serve as both the game server GS and the DB server DB.

The game server GS or the DB server DB may store personal stats of the player and rating (alternatively, grade) may be granted to the player according to the corresponding stats. One example of rating and/or grade (class) which can be granted to a player according to PPD and/or MPR is illustrated in FIG. 4.

As illustrated in FIG. 4, the point per dart (PPD) and/or the mark per round (MPR) which are a personal stat of the player are/is managed and stored and the rating (alternatively, class) corresponding thereto is granted to efficiently classify levels or rankings of the players and provide a motivation for increasing the corresponding rating.

FIGS. 5 to 8 are flowcharts of a method for providing a dart game betting mode according to an embodiment of the present disclosure.

However, the method for providing a betting mode according to the embodiment of the present disclosure is not limited to steps illustrated in FIGS. 5 to 8. That is, the method for providing a dart game betting mode according to the embodiment of the present disclosure may be performed through steps which are more or less than the steps illustrated in FIGS. 5 to 8. That is, some steps of the steps illustrated in FIGS. 5 to 8 may be omitted in the method for providing a betting mode according to the embodiment of the present disclosure and steps not illustrated in FIGS. 5 to 8 may be added to the method for providing a betting mode. Further, orders of the steps illustrated in FIGS. 5 to 8 are not limited and as necessary, the order of the steps are executed may be different from the order of the steps illustrated in FIGS. 5 to 8.

Figure 5:
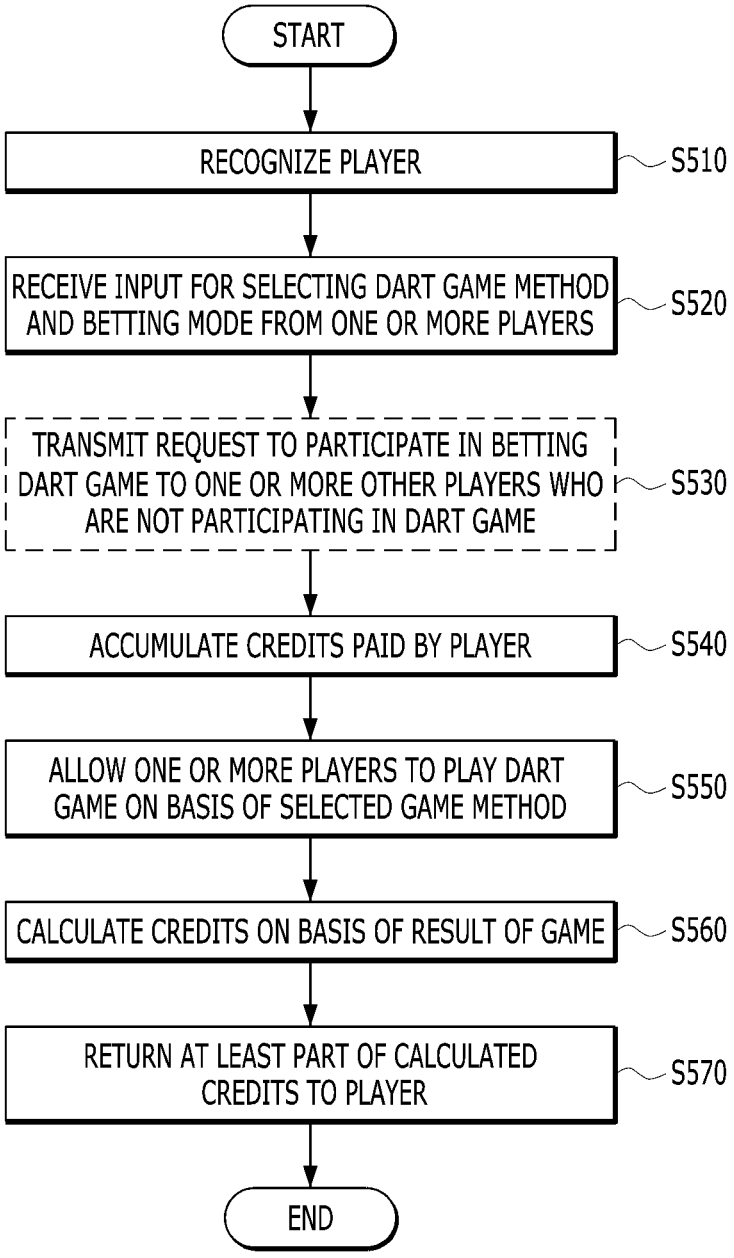
FIG. 5 is a flowchart of a method for providing a betting mode according to an embodiment of the present disclosure.

As illustrated in FIG. 5, a dart game device 100 may recognize a player which desires to play a dart game (S510). The player locates a card including an RFID chip around a user recognition unit 170 to allow a dart game device 100 to identify the player. The dart game device 100 may identify the player and load data associated with the identified player from a server based on the identified player through an RFID communication module.

The player may determine a dart game mode desired thereby and input an input for selecting the desired dart game mode in the dart game device 100 through a user input unit 130 (S520). For example, the player may verify game schemes (a cricket game, a 01 game, a count-up game, a match-up mode game, and the like) provided by the dart game device 100 through a user interface (alternatively, a user interface transferred by a voice through a sound output unit 140) provided through a display 142 and the betting mode or not. Further, the player may input an input for selecting one game scheme among them and the betting mode or not in the user input unit 130.

The cricket game, the 01 game, and the count-up game among the game schemes are the game schemes for contending for the winning/losing of the dart game. The player may select one of the game schemes and desire to play the betting mode with respect to the selected game scheme. When the player desires to play the betting mode with respect to the selected game scheme, the player may input the input for selecting the betting mode in the user input unit 130, through the user interface provided through the display 142 (S520).

In an aspect of the present disclosure, the player may select the game scheme and select the betting mode with respect to the selected game scheme or select the betting mode and select a game scheme to perform the betting mode later.

Selectively or alternatively, a step (S530) of transmitting the betting dart game participation request to one or more other players who do not participate in the dart game is performed by selection of the player. When the player desires to grant the betting dart game participation request to one or more other players, the player may input the input in the user input unit 130 through the user interface provided through the display 142. When the input is input from the player, the dart game device 100 transmits the request to another dart game device 200 through the network connection unit 160 or displays the participation request of the player by using the devices such as the smart phone, the tablet PC, the computer, the notebook, the electronic board, and the like to announce the participation request to one or more other players.

The dart game device 100 may accumulate credits paid by the player (S540). The credits may be a cash, an electronic cash, a game money, a coupon, and the like, but are not limited to the disclosure. Further, in an additional embodiment of the present disclosure, an item is submitted as the credit, and as a result, the dart game device 100 may accumulate the item by keep the item. The credit may be a value acquired by multiplying game cost of one player by the number of all players and may further include additional cost for permitting additional betting. The additional betting cost may be the item as well as the cash, the electronic cash, the game money, and the coupon. However, a predetermined limit may be set on the additional cost for permitting the betting in order to prevent aggravating speculation.

The dart game device 100 may allow one or more players to perform the dart game based on the selected game scheme (S550). The dart game is performed by the dart game schemes selected by the player, such as the cricket game, the 01 game, the count-up game, and the like and the dart game device 100 aggregates the scores of the players to output a result according to the selected game scheme.

In a step (S560) of calculating the credit based on the game result, when the game ends, the credit is calculated according to the winning/losing or the ranking of the game. In this step, the controller 190 of the dart game device 100 may determine to return at least some except for the game cost among the accumulated credits to a winner. The calculation scheme may include a winner-takes-all scheme that calculates that a player who is ranked No. 1 according to the dart game result will return all credits except for the game cost thereof or a graded payment scheme that calculates that the player will return the credit by grading with a predetermined rate according to a ranking and the disclosure is exemplary and the scope of the present disclosure is not construed to be limited by the disclosure. In an additional aspect of the present disclosure, when the dart game stops, the accumulated credits may be calculated based on play results of the one or more players until the stop point of time.

In a step (S570) of returning at least some of the calculated credits to the player, at least some except for the game cost among the accumulated credits are returned to the player according to the calculation result. According to an embodiment of the present disclosure, the returned credits may be the cash, the electronic cash, the game money, the coupon, and the like and as the credit, a gift may be paid.

Figure 6:
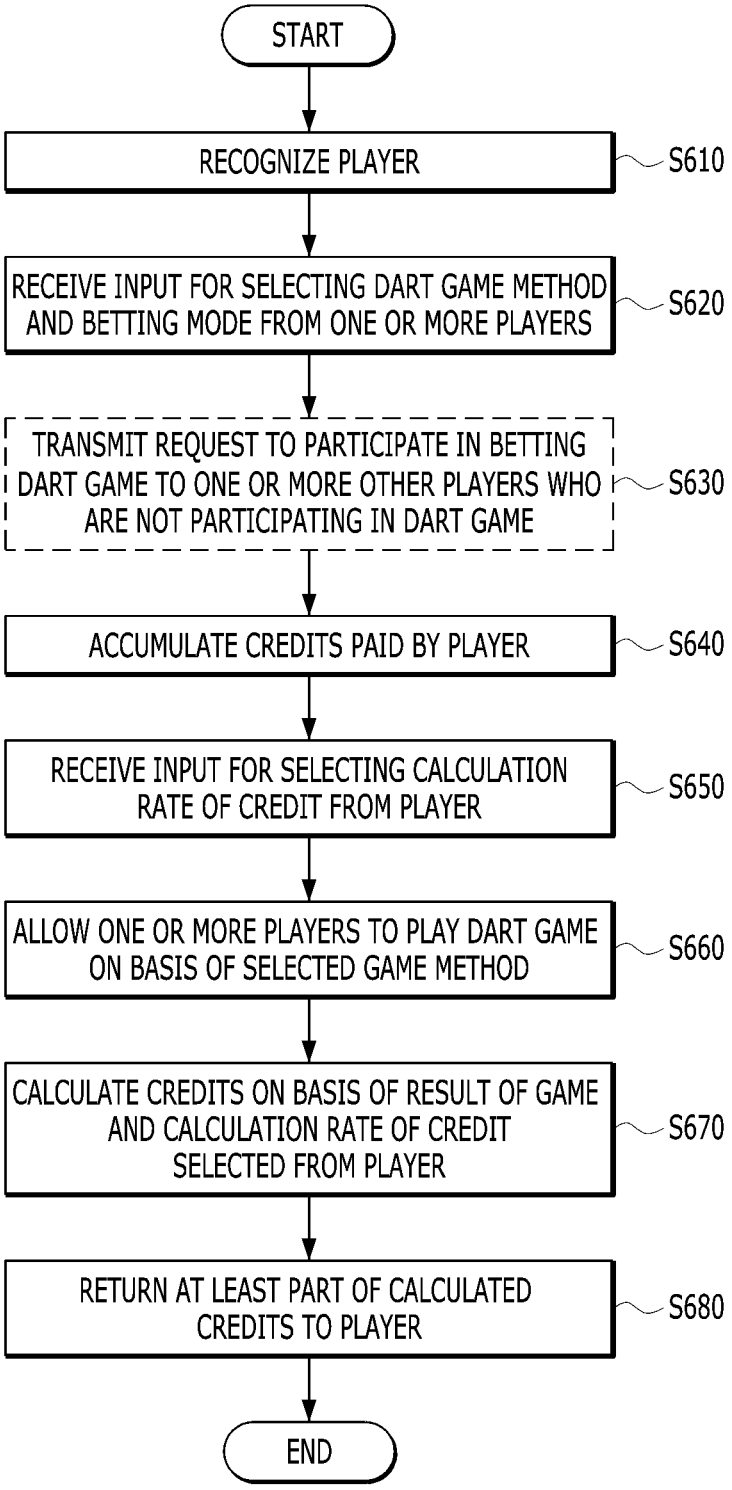
FIG. 6 is a flowchart of a method for providing a betting mode according to another embodiment of the present disclosure.

FIG. 6 is a flowchart of a method associated with a betting mode of the dart game in which a player can select a calculation rate of a credit according to an embodiment of the present disclosure.

According to an aspect of the present disclosure, provided is a game mode that allows the player to determine the calculation rate of the credit to allow the player to arbitrarily select a winner-takes-all game mode or a game mode of graded payment to return the credit through grading according to a ranking.

Steps S610 to S640 and S660 illustrated in FIG. 6 may correspond to steps 510 to S540 and S550 described with reference to FIG. 5. Therefore, hereinafter, description of the steps duplicated with the steps of FIG. 5 will be omitted.

When the player desires to select the calculation rate of the accumulated credits, the player may input an input for selecting the calculation rate of the accumulated credits through the user input unit 130 (S650). The player may select a scheme in which one winner monopolizes the credits, a scheme in which the credits are graded-paid according to the ranking, and a scheme in which more credits are paid to a player having a predetermined ranking among losers by determining a specific lucky ranking. The disclosure is just an example and it is not construed that the scope of the present disclosure is limited to the disclosure.

In a step (S670) of calculating the credit based on a game result and the calculation rate of the credit selected by the player, the credit is calculated according to the winning/losing and the ranking of the game. According to an aspect of the present disclosure, the controller 190 of the dart game device 100 may determine to return at least some except for the game cost among the accumulated credits according to the calculation rate set by the player.

In a step (S680) of returning at least some of the calculated credits to the player, at least some except for the game cost among the accumulated credits are returned to the player in accordance with the calculation rate set by the player according to the calculation result.

Figure 7:
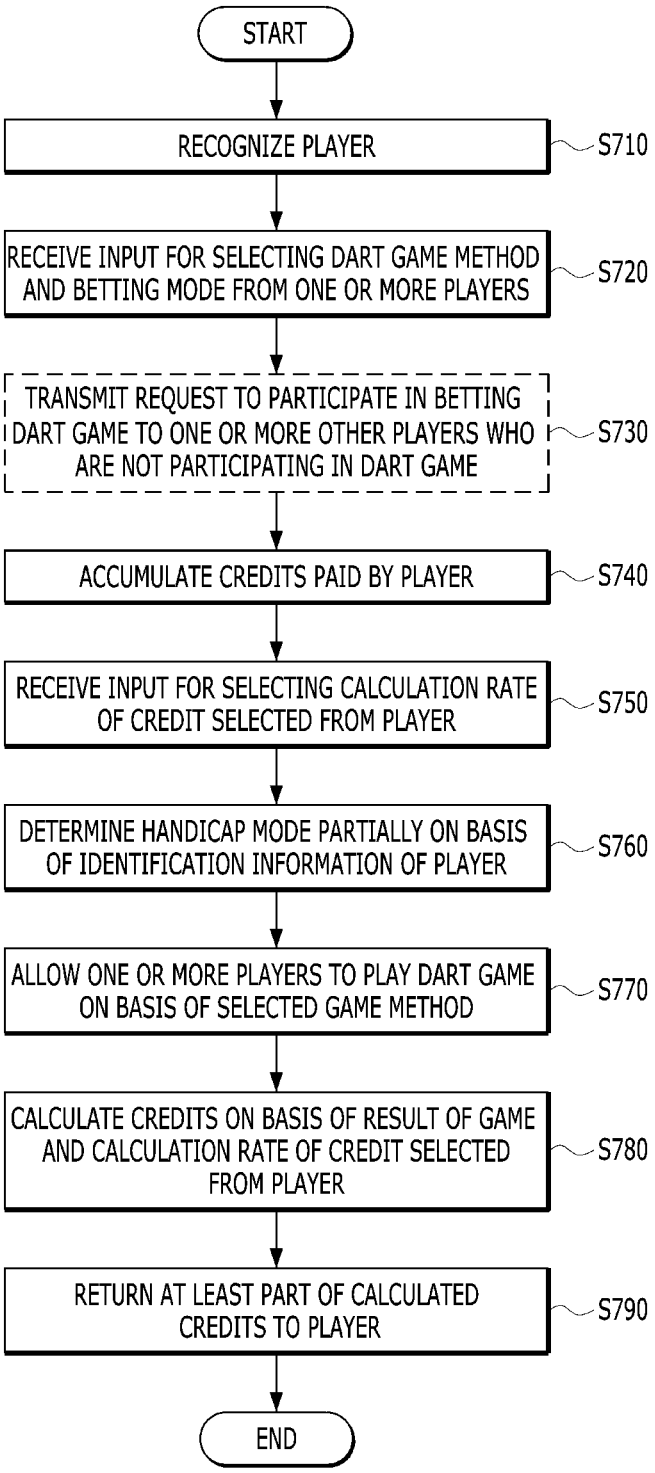
FIG. 7 is a flowchart of a method for providing a betting mode according to yet another embodiment of the present disclosure.

FIG. 7 is a flowchart of a method for providing a betting mode according to yet another embodiment of the present disclosure.

Steps S710 to S750 and steps S770 to S790 which are illustrated may correspond to steps S610 to S680 described with reference to FIG. 6. Therefore, hereinafter, description of the steps duplicated with the steps of FIG. 6 will be omitted.

FIG. 7 is a flowchart of a method for a dart game device 100 to determine a handicap mode so as to achieve fair betting partially based on identification information of a player, such as a history, a winning/losing record, a score, and the like of the player stored in a DB server DB by recognizing the player according to an embodiment of the present disclosure. In an embodiment of the present disclosure, the identification information may be the PPD and/or MPR of the player and rating (or a grade) corresponding thereto illustrated in FIG. 4. The method includes a step in which the dart game device 100 determines the handicap mode partially based on the identification information of the player (S760). In an aspect of the present disclosure, the identification information of the player may include at least one information of rating information, class information, point per dart (PPD) information, and mark per round (MPR) information.

In an aspect of the present disclosure, the handicap mode may allow scores of some players to be adjusted or respective players to throw the dart at different positions. In an additional aspect of the present disclosure, the illumination unit 143 may display the positions where the respective players throw the dart to be different from each other when the handicap mode is determined.

Figure 8:
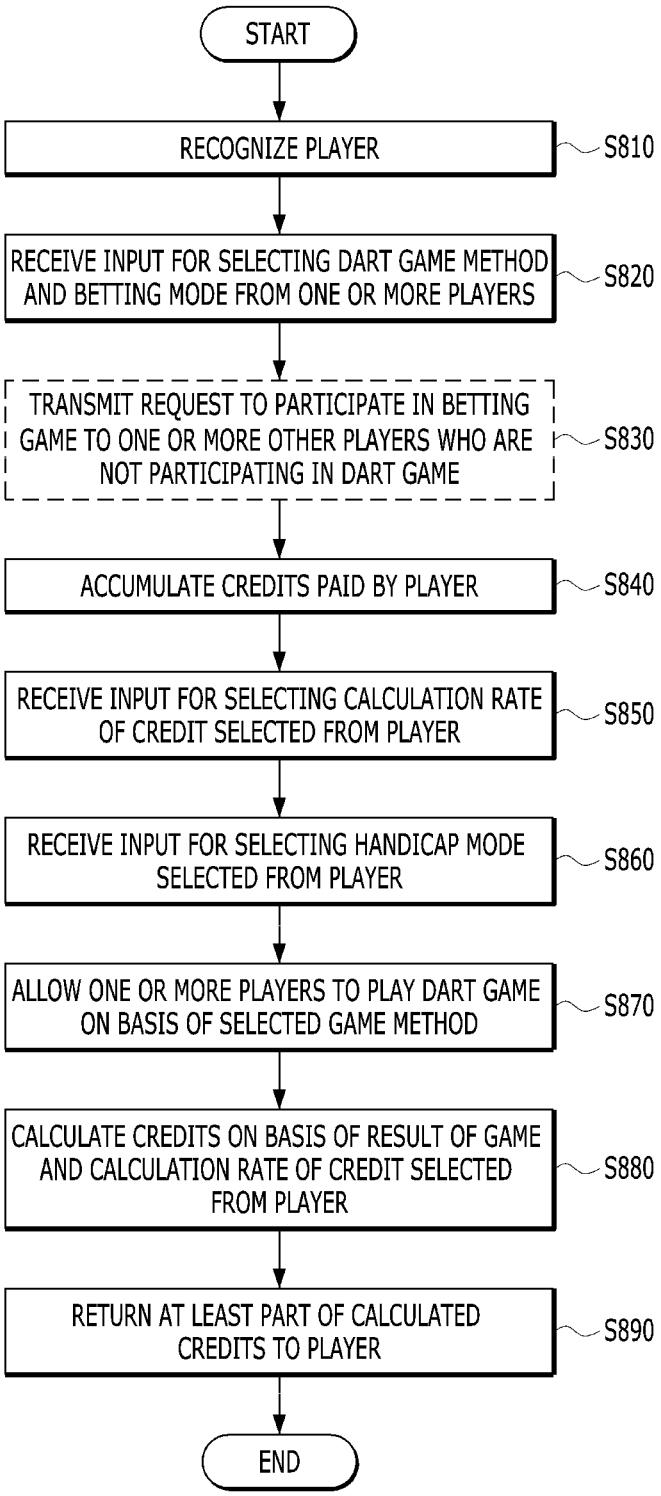
FIG. 8 is a flowchart of a method for providing a betting mode according to still yet another embodiment of the present disclosure.

Steps S810 to S850 and steps S870 to S890 which are illustrated in FIG. 8 may correspond to steps S610 to S680 described with reference to FIG. 6. Therefore, hereinafter, description of the steps duplicate with the steps of FIG. 6 will be omitted.

FIG. 8 is a flowchart of a method for a game scheme in which a player can directly select a handicap mode for fair betting according to an embodiment of the present disclosure. In the method, the player may directly select the handicap mode and the dart game device 100 receives an input of the player (S860) to determine a degree of the handicap according to each input. The method of the handicap mode is performed by the scheme that adjusts the scores of some players or makes the positions where the respective players throw the dart be different from each other. In an additional aspect of the present disclosure, the illumination unit 143 may display the positions where the respective players throw the dart to be different from each other when the handicap mode is determined.

The dart game device providing the betting mode to the player according to the embodiment of the present disclosure may be configured to include a user input unit 130 receiving from the player an input for selecting the dart game scheme and the betting mode, an input for selecting the calculation rate of the accumulated credits, and an input for selecting the handicap mode, a controller 190 accumulating the credits paid from the one or more players, allowing the one or more players to perform the dart game based on the selected dart game scheme, and calculating the credits according to the result depending on the selected game scheme and the calculation rate of the credit selected by the player, a network connection unit 160 transmitting the betting dart game participation request to one or more other players who do not participate in the dart game, and an output unit 140 outputting the result depending on the selected game scheme.

Meanwhile, various embodiments presented herein may be implemented as manufactured articles using a method, an apparatus, or a standard programming and/or engineering technique. The term "manufactured article" includes a computer program, a carrier, or a medium which is accessible by a predetermined computer-readable device. For example, a computer-readable medium includes a magnetic storage device (for example, a hard disk, a floppy disk, a magnetic strip, or the like), an optical disk (for example, a CD, a DVD, or the like), a smart card, and a flash memory device (for example, an EEPROM, a card, a stick, a key drive, or the like), but is not limited thereto. Further, various storage media presented herein include one or more devices and/or other machine-readable media for storing information. The term "machine-readable media" include a wireless channel and various other media that can store, posses, and/or transfer command(s) and/or data, but are not limited thereto.

The description of the presented embodiments is provided so that those skilled in the art of the present disclosure use or implement the present disclosure. Various modifications of the embodiments will be apparent to those skilled in the art and general principles defined herein can be applied to other embodiments without departing from the scope of the present disclosure. Therefore, the present disclosure is not limited to the embodiments presented herein, but should be analyzed within the widest range which is consistent with the principles and new features presented herein.

MODE FOR INVENTION

Associated contents have been described in a best mode for carrying out the present disclosure.

INDUSTRIAL APPLICABILITY

The present disclosure can be used in a digital device, a dart device, a dart game device, an entertainment device, and the like.

The invention claimed is:

1. A dart game device providing a betting dart game mode, the dart game device comprising:

a user input unit configured to receive an input for selecting a dart game scheme from one or more players;

a network connection unit configured to communicate between the dart game device and a network on which at least a database server, a relay server, a web server, and a game server are positioned;

a controller configured to accumulate credits paid from the one or more players, to allow the one or more players to perform a dart game based on the selected dart game scheme, to calculate the accumulated credits of the one or more players by returning at least some of the accumulated credits except for the game cost, based on a result depending on the selected game scheme, and to determine a handicap mode partially based on identification information of the one or more players;

a dart plate connected with the dart game device, configured to be extended in a horizontal direction and including an illumination unit, wherein the illumination unit is configured to display the positions where the one or more players throw the dart to be different when the handicap mode is determined; and an output unit outputting the result depending on the selected game scheme.

2. The dart game device of claim 1, wherein the network connection unit is configured to transmit a betting dart game participation request to one or more other players who do not participate in the betting dart game.

3. The dart game device of claim 1, wherein the user input unit includes a display device mapped with a dart plate.

4. A method for providing a betting dart game mode by a dart game device, the method comprising:

receiving an input for selecting a dart game scheme from one or more players;

communicating, via a network connection unit, between the dart game device and a network on which at least a database server, a relay server, a web server, and a game server are positioned;

accumulating credits paid from the one or more players;

allowing the one or more players to perform a dart game based on the selected dart game scheme;

calculating the accumulated credits of the one or more players by returning at least some of the accumulated credits except for the game cost, based on a result depending on the selected game scheme;

determining, by a controller, a handicap mode partially based on identification information of the one or more players; and displaying, via an illumination unit, positions where the one or more players throw the dart to be different when the handicap mode is determined, wherein the illumination unit is included in a dart plate connected with the dart game device and extended in a horizontal direction.

5. The method for providing a betting dart game mode of claim 4, further comprising:

receiving an input for selecting a return rate of the accumulated credits selected from a player.

6. The method for providing a betting dart game mode of claim 4, wherein the identification information of the player includes at least one of rating information of the player, class information of the player, point per dart (PPD) information of the player, and mark per round (MPR) information of the player.

7. The method for providing a betting dart game mode of claim 4, wherein the calculating includes calculating, when the dart game stops, the accumulated credits based on play results of the one or more players until the stop point of time.

8. The method for providing a betting dart game mode of claim 4, wherein the credit is a value acquired by multiplying game cost of one player by the number of all players.

9. The method for providing a betting dart game mode of claim 7, wherein the credit further includes additional cost for permitting additional betting.

10. The method for providing a betting dart game mode of claim 4, further comprising:

transmitting a betting dart game participation request to one or more other players who do not participate in the betting dart game.

11. The method for providing a betting dart game mode of claim 4, wherein in the receiving of the input, the input is received through an input device mapped with a dart plate.

12. A non-transitory computer readable medium having a program which allows a computer to provide a betting mode to a player of a dart game device recorded therein when the program is executed by the computer, wherein the program includes:

a code for allowing the computer to receive an input for selecting a dart game scheme from one or more players;

a code for communicating between the dart game device and a network on which at least a database server, a relay server, a web server, and a game server are positioned;

a code for allowing the computer to accumulate paid credits from the one or more players;

a code for allowing the computer to allow the one or more players to perform a dart game to be performed based on the selected game scheme;

a code for allowing the computer to calculate the accumulated credits of the one or more players by returning at least some of the accumulated credits except for the game cost, based on a result depending on the selected game scheme;

a code for determining, by a controller, a handicap mode partially based on identification information of the one or more players; and a code for displaying, via an illumination unit, positions where the one or more players throw the dart to be different when the handicap mode is determined, wherein the illumination unit is included in a dart plate connected with the dart game device and extended in a horizontal direction.

13. The dart game device of claim 1, further comprising a user recognition unit configured to recognize unique information of a user for identifying the player and loading data associated with the identified player from the database server based on the identified player.

14. The dart game device of claim 1, wherein the user input unit is configured to receive an input for selecting a betting mode from the one or more players, and wherein the controller is configured to determine the handicap mode for applying advantages or disadvantages related to dart game players to the one or more players at least partially based on the loaded data associated with the identified one or more players.

* * * * *